United States Patent [19]

Ramsay

[11] Patent Number: 4,982,200

[45] Date of Patent: Jan. 1, 1991

[54] FLUID JET PRINTING DEVICE

[75] Inventor: Wilhelm Ramsay, Nyhamnslaege, Sweden

[73] Assignee: Swedot System AB, Göteborg, Sweden

[21] Appl. No.: 7,244

[22] PCT Filed: May 30, 1986

[86] PCT No.: PCT/EP86/00323

§ 371 Date: Jan. 13, 1987

§ 102(e) Date: Jan. 13, 1987

[87] PCT Pub. No.: WO86/07310

PCT Pub. Date: Dec. 8, 1986

[30] Foreign Application Priority Data

Jun. 13, 1985 [SE] Sweden ..... 85 02947

[51] Int. Cl.[5] ..... B41J 2/175

[52] U.S. Cl. ..... 346/75; 101/366; 346/140 R

[58] Field of Search ..... 346/75, 140; 101/366; 222/325, 82, 91; 239/271, 272, 274, 320, 337

[56] References Cited

U.S. PATENT DOCUMENTS

| | | | |
|---|---|---|---|
| Re. 25,692 | 12/1964 | Brown | 346/140 |
| 3,099,211 | 7/1963 | Hilgoe | 101/366 X |
| 3,572,591 | 3/1971 | Brown | 239/337 |
| 3,756,512 | 9/1973 | Dyal | 239/337 |
| 3,945,021 | 3/1976 | Kraus | 346/75 |
| 4,089,007 | 5/1978 | Perry | 346/140 |
| 4,204,215 | 5/1980 | Nakarai | 346/140 |
| 4,346,388 | 8/1982 | Wiley | 346/75 |
| 4,378,564 | 3/1983 | Cross | 346/75 |
| 4,423,429 | 12/1983 | Rosel | 346/140 |
| 4,453,650 | 6/1984 | Witte | 222/43 |

OTHER PUBLICATIONS

Umezawa, Patent Abstracts of Japan, vol. 7, No. 211, M-243, 1356, Sep. 17, 1983, Japanese Publication No. 58-107348 issued Jun. 27, 1983.

*Primary Examiner*—Joseph W. Hartary
*Attorney, Agent, or Firm*—Flynn, Thiel, Boutell & Tanis

[57] ABSTRACT

A fluid jet printing device has a source (6 to 10) for supplying fluid under pressure to a printer head (1). The source consists of an interchangeable, pressure-tight, inflexible container (6) filled with pressurizing gas and printing fluid. The container is detachably connected to an inlet port connected to a pressure reducing valve for supplying the fluid under constant pressure to the printer head. Preferably, the fluid container has the form of a spray-dispenser of a 'throw-away' type, as known for hairsprays or the like.

5 Claims, 1 Drawing Sheet

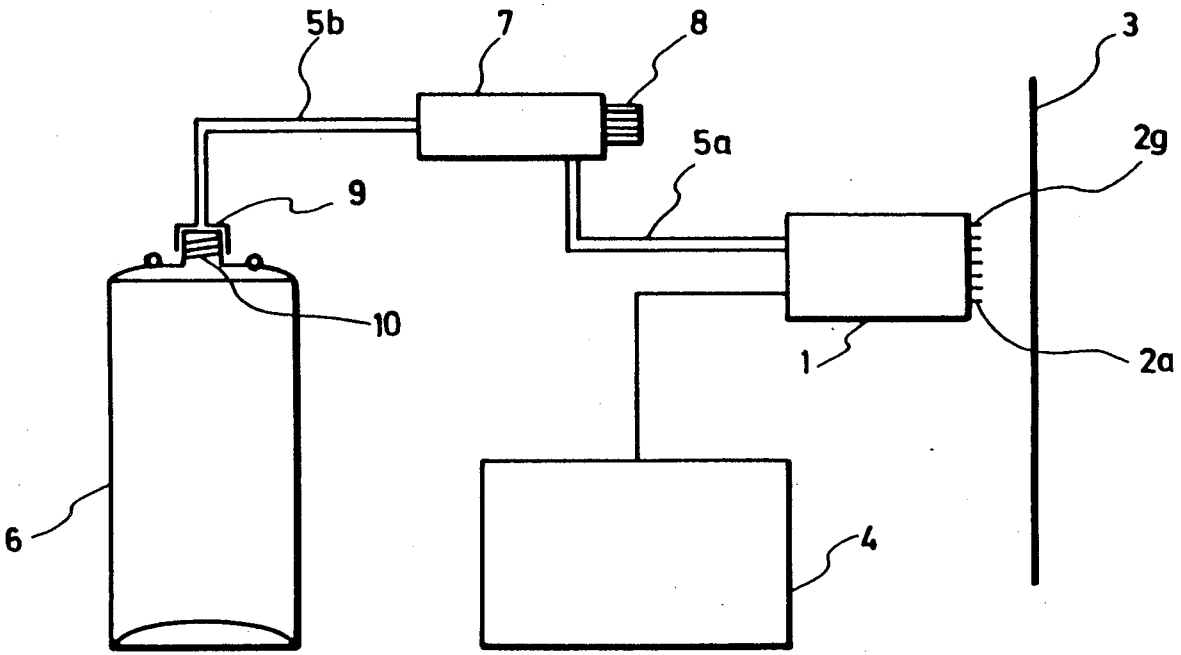
3
2g
2a
1
4
8
5a
7
5b
9
10
6

FLUID JET PRINTING DEVICE

The present invention relates to the field of fluid jet printing devices and, more particularly, to an improved fluid supply system for fluid jet printing devices.

Usually, fluid jet printing devices have a refillable fluid tank connected via a supply duct to a fluid pump feeding the fluid under pressure to a controllable valve, which valve in turn is connected to a printer head. Jet nozzles arranged in the printer head generate fluid jets upon actuation of said controllable valve.

Different printing fluids, like ink, which are commercially available under different brands, have extremely different properties, so that only specific types of printing fluids can be used for specific fluid jet printing devices. The use of unsuitable printing or marking fluids for a particular fluid jet printing device will either result in bad printing quality or in a complete malfunction of the printing device. Another problem or prior art printing devices exists in that exposing the marking or printing fluid to light may cause a growth of algae in the fluid, if the fluid contains biologically active components, which is primarily the case when making use of water based marking fluid.

In view of this state of art, the present invention is based on the technical task of how to further optimise a fluid jet printing device of the above indicated kind, so as to prevent the use of printing fluid that is unsuitable for a fluid jet printing device and for preventing the printing fluid or marking fluid from being exposed to light.

This object is achieved by a fluid jet printing device of the above mentioned kind, wherein the fluid supply means comprises an interchangeable, pressure-tight essentially inflexible container which is filled with pressurising gas and which is detachably connected to a fluid inlet port of the fluid jet printing device, which fluid inlet port is connected to a pressure reducing valve supplying the fluid under essentially constant pressure independent of the fluid pressure at the inlet port, to a controllable valve, which in turn is connected to a printer head of the fluid jet printing device.

In accordance with the present invention, the refillable printing fluid tank and the fluid pump for feeding the fluid under pressure to the controllable valve are replaced by an interchangeable pressure-tight container, which is filled with a pressurising gas and with said printing fluid, which container has essentially the form of a spray dispenser of a "throw-away" type known per se in the art. Hence the fluid jet printing device in accordance with the present invention now only prevents the printing fluid from being exposed to light, so as to avoid a growth of algae in the fluid, but also allows an uncomplicated, compact design of a portable printer not requiring any pump for supplying the fluid under pressure to the controllable valve.

In addition, the cumbersome and dirty refilling procedure of the prior art device is now substituted by simply interchanging the empty container by a new one, which allows a clean, spill-free handling of the printing or marking fluid. Hereinafter, a preferred embodiment of the present invention will be described in detail with reference to the attached drawing.

The only FIGURE shows a sideview of a fluid jet printing device connected to a fluid container.

The fluid jet printing device comprises a printer head 1 having a plurality of jet nozzles 2a to 2g controlled by respective solenoid valves (not shown here) to apply dot patterns, together forming desired alpha-numeric characters on an information carrier 3, for example in the form of a sheet or package of goods. The solenoid valves controlling the jet nozzles 2a to 2g are connected to an electric control unit 4. The above arrangement of the printer head, the jet nozzles, the solenoid valves and the electric control unit is known per se in the art. A fluid source supplies the printing or marking fluid through a supply duct 5a to the printer head 1. The fluid source has the form of a pressure container 6 which is filled with pressurising gas and with the printing fluid. The container may have the form of a spray-dispenser of a "throw-away" type which is in widespread use today for storing and dispensing consumer products like different sprays, deodorants, shaving cream etc.. The spray-dispenser is an interchangeable, pressure-tight, essentially inflexible container, which can be detachable connected to a fluid inlet port 9 of the fluid jet printing device. For this purpose, the fluid container 6 has an outlet port 10 matching with the fluid inlet port 9. Hence, only fluid containers being filled with a suitable ink can be attached to a fluid jet printing device.

Preferably, the outlet port 10 of the fluid container 6 comprises an outlet valve which is actuated when connecting the outlet port 10 of the fluid container 6 to the inlet port 9 of the fluid jet printing device.

The inlet port 9 is in turn in fluid connection with a pressure reducing valve 7 supplying the fluid under essentially constant pressure to the controllable valve 7. Various embodiments of spray-dispensers of spray-bottles are available which can be used as a fluid container for the fluid jet printing device in accordance with the present invention. Most of these spray-dispensers or spray-bottles contain a pressurising gas like petroleum gas as a driving gas for pressurising the fluid contained therein. In that case, there is a relatively great difference between the pressure in the fluid of a full dispenser, which is approximately in the order of 5 bars, and the pressure in the fluid of an almost empty dispenser. The printing head requires a constant inlet pressure. For this reason, the pressure reducing valve 7 reduces the inlet pressure thereof and generates a constant outlet pressure of approximately 0.25 bars. The pressure reducing valve 7 may be provided with an adjustment screw 8 for adjusting the fluid pressure level at its outlet side.

The embodiments of the invention in which an exclusive property or priviledge is claimed are defined as follows:

1. In a fluid jet printing device having a printing fluid consumer, a pressure regulating valve, and an essentially inflexible fluid supply container which contains a printing fluid and a pressurizing gas, said container being connected to said printing-fluid consumer through said pressure regulating valve, said pressure regulating valve regulating the pressure of the printing fluid supplied to said printing fluid consumer, and having an inlet port connected to an outlet of said container, the improvement comprising wherein said container is a single-use, non-refillable, disposable dispenser, wherein said inlet port is matched with said outlet of said container, and wherein said pressure regulating valve is a pressure reducing valve which maintains an essentially constant outlet pressure independently of the pressure at the outlet of said container.

2. A fluid jet printing device according to claim 1, wherein said outlet of said container has therein a normally closed outlet valve which is automatically opened upon connection of said inlet port to said outlet.

* * * * *

UNITED STATES PATENT AND TRADEMARK OFFICE

CERTIFICATE OF CORRECTION

PATENT NO. : 4 982 200

DATED : January 1, 1991

INVENTOR(S) : Vilhelm Ramsay

It is certified that error appears in the above-identified patent and that said Letters Patent is hereby corrected as shown below:

ON TITLE PAGE: of the patent, change the inventor's name from "Wilhelm Ramsay" to ---Vilhelm Ramsay---.

Signed and Sealed this

First Day of September, 1992

*Attest:*

DOUGLAS B. COMER

*Attesting Officer*

*Acting Commissioner of Patents and Trademarks*